United States Patent [19]

Aoki et al.

[11] 4,389,998

[45] Jun. 28, 1983

[54] DISTRIBUTION TYPE FUEL INJECTION PUMP

[75] Inventors: Hachiro Aoki; Hitoshi Tomita, both of Higashimatsuyama; Kiyoshi Nagamata, Kohnan, all of Japan

[73] Assignee: Diesel Kiki Co., Ltd., Tokyo, Japan

[21] Appl. No.: 199,528

[22] Filed: Oct. 22, 1980

[30] Foreign Application Priority Data

Oct. 24, 1979 [JP] Japan ..... 54-146251[U]

[51] Int. Cl.[3] ..... F02M 59/20

[52] U.S. Cl. ..... 123/502

[58] Field of Search ..... 123/502, 501

[56] References Cited

U.S. PATENT DOCUMENTS

| | | | |
|---|---|---|---|
| 3,943,902 | 3/1976 | Skinner | 123/502 |
| 4,143,632 | 3/1979 | Kobayashi | 123/502 |
| 4,214,564 | 7/1980 | Skinner | 123/502 |
| 4,273,090 | 6/1981 | Hofer et al. | 123/502 |
| 4,316,441 | 2/1982 | Sakuranaka et al. | 123/502 |

FOREIGN PATENT DOCUMENTS

| | | | |
|---|---|---|---|
| 2620520 | 12/1977 | Fed. Rep. of Germany | 123/502 |
| 54-31822 | 3/1979 | Japan | 123/502 |
| 54-47910 | 10/1979 | Japan | 123/502 |

*Primary Examiner*—Ira S. Lazarus
*Assistant Examiner*—Magdalen Moy
*Attorney, Agent, or Firm*—Birch, Stewart, Kolasch & Birch

[57] ABSTRACT

A distribution type fuel injection pump for use in a fuel injection combustion engine comprising a plunger capable of moving reciprocally along its axis and simultaneously rotating about its axis and a couple of members forming a cam mechanism having a first cam member and a second cam member. The first cam member is mounted on the plunger and the second cam member is mounted on a housing rotatably about its axis. The couple of cam members cause the plunger to move reciprocally while the plunger is rotating. The angular position of the second cam member about its axis can be controlled by a fuel injection timing control means in accordance with the engine speed. The second cam member can also turn about its axis so as to be adjusted in its angular position by a fuel injection timing adjusting means when the engine is substantially operated at the low speed, for example, at the time of engine start. An auxiliary fuel injection timing adjusting means causes the fuel injection timing adjusting means to auxiliarily adjust in angular position only when the low engine temperature is below a predetermined level.

4 Claims, 3 Drawing Figures

DISTRIBUTION TYPE FUEL INJECTION PUMP

BACKGROUND OF THE INVENTION

The present invention relates to a distribution type fuel injection pump for use in an internal combustion engine, such as a diesel engine.

In conventional distribution type fuel injection pumps wherein a plunger is mounted on a barrel so as to be capable of reciprocal axial movement to suck and to pressurize a fuel and rotate about its axis to distribute the pressurized fuel to each combustion chamber of the engine, an injection timing apparatus (so called engine speed timer) is disposed. The injection timing apparatus automatically advances the injection timing in accordance with an increase in the engine revolutions, i.e. engine speed.

On the other hand, in an injection type internal combustion engine, such as a diesel engine, in order to easily start the engine, it is necessary to advance the injection timing at the time of the engine starting operation. That requirement is more important in a cold engine condition.

Accordingly, in the conventional injection timing apparatus, an auxiliary injection timing adjusting means for advancing the injection timing at the time of the engine starting operation has been employed. The auxiliary injection timing adjusting means taught by an invention cited in the Japanese patent application No. Sho 53-133561 (Japanese publication No. Sho 55-49078) filed in the Japanese Patent Office by an applicant of this present invention is one of the most available means for advancing the injection timing at the time of the engine starting. That means teaches the follows. The distribution type fuel injection pump comprises a cam member causing the plunger to reciprocally move while the plunger rotates to distribute the fuel into each combustion chamber of the engine. The angular position of the cam member about its axis can be controlled by a timer piston operable as the fuel injection timing control means to advance the fuel injection timing in response to the engine speed. The cam member also turns about its axis so as to be adjusted in its angular position by an auxiliary piston disposed on the same axial line as that of the timer piston. The auxiliary piston causes the timer piston to adjust to advance the fuel injection timing at the low engine speed, for example at the time of engine starting.

When the above-mentioned conventional arrangement is adopted, the intended object can be attained if the engine temperature is low at the time of engine starting. The starting injection timing, however, is held even at the time of engine restarting in the warming-up state where maintenance of the starting injection timing is not especially necessary. Accordingly, the content of NOx components in the exhaust gas is increased, and abnormal combustion such as knocking is caused thus increasing the noise of operation.

SUMMARY OF THE INVENTION

An object of the present invention is to provide a distribution type fuel injection pump capable of automatically advancing the injection timing at the time of the engine starting operation only if the engine temperature is below the predetermined level.

Another object of the present invention is to provide a distribution type fuel injection pump constructed to be a simple structure with minor change of the conventional distribution type fuel injection pump which has been proposed before by the applicant of the present invention.

According to the present invention, there is provided a fuel injection pump for use in a fuel injection combustion engine, comprising: a housing having a fuel chamber therein, a plunger movably mounted on said housing and forming a plunger chamber over a head of said plunger, first cam means fixedly mounted on said plunger, second cam means turnably mounted on said housing and cooperating with said first cam means so as to cause reciprocal motion of said plunger along the axis thereof during plunger rotation with respect to said second cam means, said second cam means being capable of taking one of a plurality of angular positions thereof, fuel supply means for introducing fuel into said plunger at the suction stroke of said plunger, a delivery port for feeding fuel to the engine from said plunger chamber at the delivery stroke of said plunger, a leak port formed in said plunger and connected to said plunger chamber, a control sleeve slidably mounted on said plunger for normally closing said leak port and for connecting said leak port to said fuel chamber at the end of the delivery stroke to terminate the fuel injection, a governor device actuating said control sleeve for controlling the quantity of fuel to be injected, injection timing control means for controlling the angular position of said second cam means in response to the engine speed, injection timing adjusting means for providing an adjusted movement of said second cam means toward a predetermined angular position advancing a fuel injection timing under a preselected operating condition of said engine at the low engine speed range, and, auxiliary injection timing adjusting means for releasing the adjusting movement of said second cam means by said injection timing adjusting means when the engine temperature is elevated over a predetermined level so as to effect the controlling of the angular position of said second cam means in response to the engine speed by said injection timing control means.

The present invention may be more fully understood from the following description of preferred embodiments of the invention, together with the accompanying drawings.

DESCRIPTION OF PREFERRED EMBODIMENTS

Figure 1:
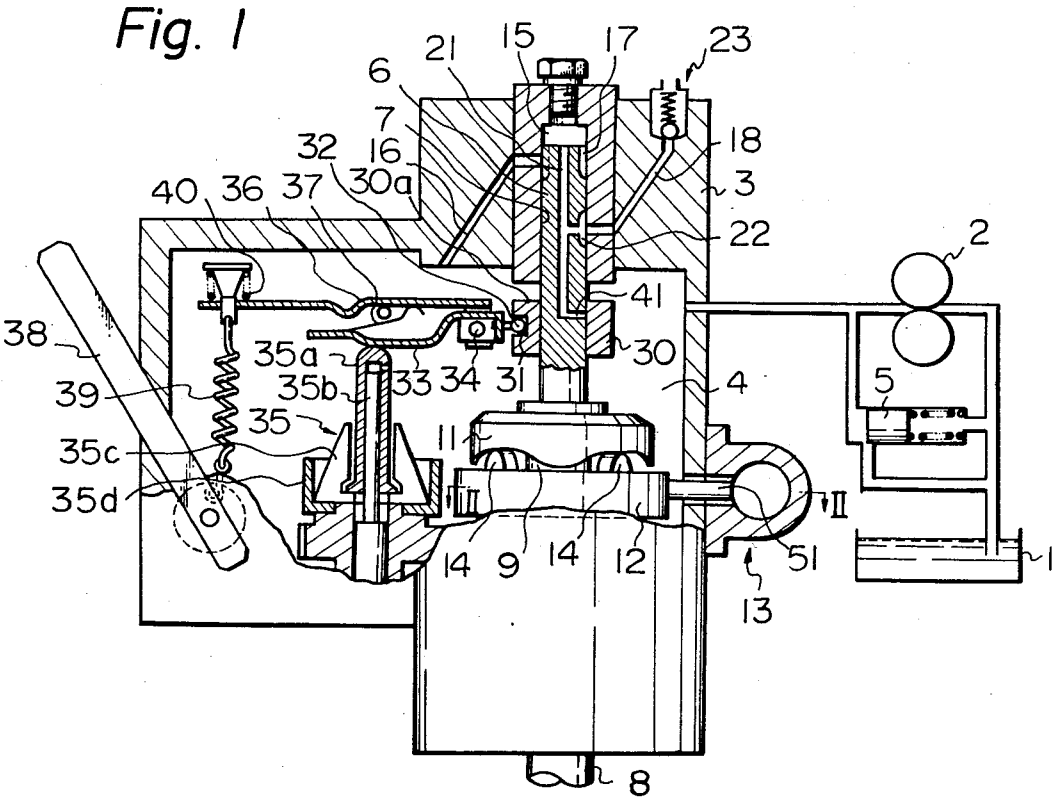
FIG. 1 is a cross-sectional side view of a fuel injection pump according to the present invention.
Figure 2:
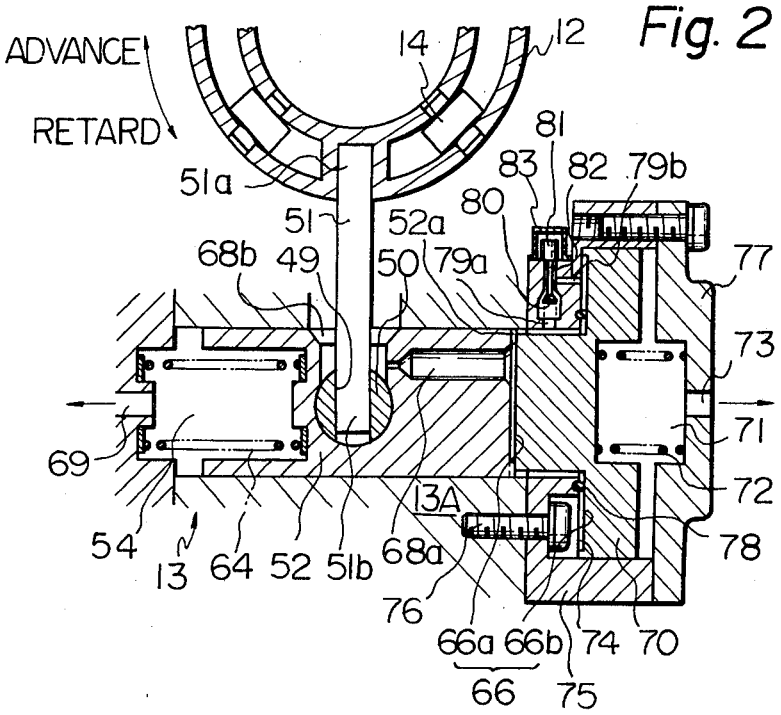
FIG. 2 is a cross-sectional view taken along the line II—II in FIG. 1.

Referring to FIGS. 1 and 2, fuel is sucked from a fuel tank 1 by means of a fuel pump 2 and then fed into a fuel chamber 4 formed in a pump housing 3. As is known to those skilled in the art, since the delivery pressure of the fuel pump 2 is increased in accordance with increase in the number of engine revolution i.e. the engine speed by the help of the fuel pressure control function of a pressure control valve 5, the fuel pressure in the fuel chamber 4 is increased in accordance with increase in the engine speed.

A pump plunger 6 is movably inserted into a barrel 7 formed in the pump housing 3 and, as is hereinafter described, this pump plunger 6 is rotated about its axis and reciprocally axially moved up and down. In FIG. 1, reference numeral 8 designates a drive shaft which is driven by an engine and the lower end 9 of the plunger 6 is engaged with the upper end of the drive shaft 8 so that the plunger 6 rotates together with the drive shaft 8 and in addition, the plunger 6 moves up and down relative to the drive shaft 8. A cam disc 11 is fixed onto the plunger 6 and, thus, the cam disc 11 rotates together with the plunger 6. This cam disc 11 has on its lower end a circular cam face which forms a plurality of projections. In this embodiment, the number of these projections corresponds to that of combustion chambers of the engine. A roller holder 12 is arranged beneath the cam disc 11 in the fuel chamber 4 and is rotated by means of a piston-cylinder mechanism 13 (FIG. 2) acting as a fuel injection timing control means which serves to advance the injection timing in accordance with increase in the pressure within the fuel chamber 4, that is, in the engine speed. The piston-cylinder mechanism 13 will be hereinafter explained in detail.

The roller holder 12 has a plurality of rollers 14 which are always in contact with the circular cam face of the cam disc 11 so as to cause the plunger 6 to move upwards when the peaks of the circular cam face of the cam disc 11 move on the rollers. Consequently, when the drive shaft 8 is driven, the plunger 6 reciprocally moves up and down while, at the same time, rotating about its axis.

At the time of the suction stroke of the plunger 6, that is, when the plunger 6 moves downwards in FIG. 1, fuel is fed into a plunger chamber 15 of the barrel 7 from the fuel chamber 4 via a fuel feed port 16 formed in the pump housing 3 and via one of a plurality of longitudinal grooves 17 formed on the outer periphery of the top portion of the plunger 6.

On the other hand, in the delivery stroke of the plunger 6, the longitudinal groove 17 is disconnected from the fuel feed port 16 immediately after the upward movement of the plunger 6 is started. When the plunger 6 further moves upwards, the fuel in the plunger chamber 15 is fed into one of distribution ports 18 via a central bore 21 and a transverse bore 27 and then fed into the fuel injector (not shown) via a check valve 23. Thus, the injecting operation is carried out.

As illustrated in FIG. 1, a control sleeve 30 is slidably mounted on the plunger 6. A circumferential groove 31 is formed on the outer peripheral surface of the control sleeve 30, and one end 32 of a lever 33 which is pivotably mounted on the pivot pin 34 is fitted into the circumferential groove 31. The other end of the lever 33 is so arranged always to engage with a centrifugal governor 35 so that the lever 33 is actuated by the centrifugal governor 35.

The centrifugal governor 35 is a known type engine speed governor as illustrated below. The lever 33 faces the operation end of a centrifugal governor sleeve 35*a*, and this sleeve 35*a* is moved in the axial direction on a sliding shaft 35*b* by a fly-weight 35*c*. The fly-weight 35*c* is mounted on a pocket member 35*d* which is driven by the engine. Accordingly, the fly-weight 35*c* is moved outwardly in the radial direction basing on the centrifugal force in correspondence to the engine speed by the pocket member 35*d* then the centrifugal force is transmitted to the lever 33 so as to shift the lever 33 upwardly. Namely, with increase of the engine speed, the lever 33 is turned around the pin 34 in the clockwise direction as shown in FIG. 1 to bring down the control sleeve 30. In addition, one end of a tension lever 36 is pivotably mounted on the pivot pin 34, and the lever 33 is resiliently engaged with the tension lever 36 via a start spring 37. Furthermore, a control lever 38, which is connected to the acceleration pedal (not shown), is connected to one end of the tension lever 36 via a main spring 39 and an idle spring 40.

FIG. 1 shows the moment when an engine is started. At this time, as is illustrated in FIG. 1, the control sleeve 30 is positioned at its uppermost position. Once the engine is started, the speed of same is gradually increased and then, the engine is operated under an idling condition slightly after the start. At this time, the control sleeve 30 moves down to a slight extent from its uppermost position shown in FIG. 1 due to the upward movement of the centrifugal governor 35. As is illustrated in FIG. 1, another transverse cut-off port 41 which is in communication with the central bore 21 is formed in the middle portion of the plunger 6 so that the cut-off port 41 is closed by the cylindrical inner wall of the control sleeve 31 when the plunger 6 is positioned at its lower position. As mentioned above, fuel in the plunger chamber 15 is gradually fed into the distribution port 18 as the plunger 6 moves upwards. When the plunger 6 approaches its uppermost position, the transverse bore 41 moves upwards beyond the upper surface 30*a* of the control sleeve 30 and opens into the fuel chamber 4. At this time, the fuel under pressure in the plunger chamber 15 is discharged into the fuel chamber 4 via the center bore 21 and the cut-off port 41 and as a result, the injecting operation of fuel is stopped. As mentioned above, the control sleeve 30 is positioned at its uppermost position at the moment the engine is started. In addition, the control sleeve 30 moves downwards as the number of engine revolutions is increased. Consequently, from FIG. 1, it will be understood that, as the number of engine revolutions is increased, the terminal moment of the fuel injection is advanced, that is, the amount of fuel injected into the cylinders of an engine is reduced.

An embodiment of the injection timing control mechanism of the present invention, which can advance the injection timing automatically at the engine starting only in the cold engine condition will now be described by referring to FIG. 2 and FIG. 3. The piston-cylinder mechanism 13 never advances the injection timing at the engine starting because of the low engine speed and therefore the low fuel pressure.

The roller holder 12 is disposed in the housing 3 so that it can rotate concentrically with the drive shaft 8. One end 51*a* of a lever 51 is fixedly connected to a peripheral outer portion of the roller holder 12, and the other end 51*b* of the lever 51 is slidably fitted in a bore 49 formed in a ball 50 which is rotatably joined with a timer piston 52. A chamber 54 containing a spring 64 therein and a pressure chamber 66, in which the pressurized fuel in the fuel chamber 4 is introduced via passages 68*a* and 68*b* formed in the timer piston 52, are disposed in a cylinder 13A at both ends of the timer piston 52, respectively. Namely, the position of the timer piston 52 is determined depending on the relation between the force of spring 64 effected against the piston and the fuel pressure according to the engine speed also effected on the opposite side face of the piston. Therefore the position of the roller holder 12 with respect to the circumferential direction is determined depending on the relation through the lever 51. The change of the position of the roller holder 12 with respect to the circumferential direction results in a change of the position of contact between the roller 14 and the cam face of the cam disc 11. As a result, the moment when the peaks of the cam face of the cam disc 11 are engaged with the rollers to move the plunger 6 upwardly, i.e. in the delivery stroke, is changed with reference to the rotating angle of the plunger, that is a crank angle of the engine, and therefore, the injection timing can be changed relative to the crank angle. Incidentally, in the above arrangement, when the timer piston 52 is moved leftwards as shown in FIG. 2 against the elasticity of the spring 64 by the fuel pressure, the roller holder 12 is turned in the clockwise direction to advance the injection timing.

On the other hand, when the timer piston 52 is moved rightwards in FIG. 2 by the elasticity of the spring 64, the injection timing is retarded. Reference numeral 69 represents a communicating hole for opening the chamber 54 to the low pressure side.

An auxiliary piston 70 is effected to move as a fuel injection timing adjusting means. The auxiliary piston 70 having one end exposed to the pressure chamber 66 is slidably mounted on the auxiliary cylinder 75 coaxially with the axial line of the timer piston 52 for adjusting the injection timing in the above-mentioned manner, so that both the piston 52 and the piston 70 confront each other in the state where the end surface of the auxiliary piston 70 can be brought in butting contact with a projection projected from a partial portion of an end surface of the timer piston 52. The auxiliary cylinder 75 is secured to the end surface of the cylinder 13A by means of a bolt 76. The pressure-receiving area A2 of the auxiliary piston 70 facing to the pressure chamber 66 is larger than that of the pressure-receiving area A1 of the timer piston 52.

A spring 72 is inserted in a chamber 71 which is formed between the auxiliary cylinder 75 and an end plate 77 secured to the cylinder 75 so that the auxiliary piston 70 is located between the pressure chamber 66 and this chamber 71. The auxiliary piston 70 is urged leftwardly in FIG. 2 and brought into abutting contact with the timer piston 52 by means of the elasticity of this spring 72. The elasticity F2 of the spring in the chamber 71 is set higher than the elasticity F1 of the spring in the chamber 54. Further, these elasticities F1 and F2 as well as the pressure-receiving areas A1 and A2 of the timer piston 52 and the auxiliary piston 70, respectively satisfy the following inequality, $F1/A1 > F2/A2$. Reference numeral 73 represents a communicating hole penetrating through the end plate 77 for opening the chamber 71 to the low pressure side.

The movement of the auxiliary piston 70 to the left in the drawings is regulated by butting contact of a shoulder 74 of the auxiliary piston 70 with one wall face of the pressure chamber 66, namely, the movement of the timer piston 52 to the injection timing retarding direction is restricted at butting contact with the auxiliary piston 70.

In the state of this butting contact, a seal ring 78 attached to an end face of the auxiliary cylinder 75 partitions the interior of the pressure chamber 76 into an inner chamber **66*a* and a peripheral chamber 66*b*. Accordingly, when the state of this abutting contact is effected, the substantial pressure-receiving area of the auxiliary piston 70 to the pressure chamber 66 is reduced. When the auxiliary piston 70 is moved rightwardly in the drawings against the elasticity of the spring 72, since the end face of the auxiliary piston 70 rises from the seal ring 78, both the pressure chambers 66*a* and 66*b* are communicated with each other and forms a single pressure chamber 66. At this point, the pressure-receiving area of the auxiliary piston 70 to the pressure chamber 66** is increased.

A normally closed valve 80 operable as an auxiliary injection timing means is disposed between a communicating passages **79*a* and 79*b* for communicating both the pressure chambers 66*a* and 66*b* with each other. This valve 80 is connected to a movable member 82 of an actuator 81 secured to the auxiliary cylinder 70 in which wax pellets connected to the movable member 82 are sealed, so that when elevation of the engine temperature above a predetermined level is detected by the wax pellets through the temperature of cooling water fed and circulated in a housing 83, the wax pellets are expanded to move the movable member 82 downwardly in the drawing as well as the valve 80, then the valve 80** is opened.

In the above-mentioned structure, since the fuel pressure in the pressure chamber 76 is extremely low at the time of the engine starting, the timer piston 52 is moved rightwardly in the drawings by the elasticity of the spring 64, and the auxiliary piston 70 is moved leftwardly by the elasticity of the spring 72, whereby both the piston 70 and the projection of the piston 52 are brought into abutting contact with each other. At this point, since the elasticity F2 of the spring 72 is sufficiently larger than the elasticity F1 of the spring 64, the movement of the auxiliary piston 70 to the left is preferentially caused, so that the timer piston 52 is held at the position shown in FIG. 2 to maintain the starting injection timing advanced.

When the rotation speed of the engine is elevated after starting to a level corresponding to the idling rotation speed, the inner pressure in the pressure chamber 66 is proportionally elevated. This pressure firstly acts on the central pressure chamber **66*a*, and the auxiliary piston 70 is pressed rightwardly by some extent, then the compressed fuel is supplied also to the auxiliary peripheral pressure chamber 66*b*. Therefore, since the pressure receiving surface of the auxiliary piston 70 is enlarged, as the number of rotation speed of the engine is elevated to a predetermined level, the auxiliary piston 70 is moved rightwardly substantially in a moment against the elasticity of the spring 72. At the same time, also the timer piston 52 has a tendency to move leftwardly in the drawings. But since the pressure-receiving area of the timer piston 52 is smaller than that of auxiliary piston 70, the timer piston 52 is shifted to the right by the elasticity of the spring 72**, whereby the starting injection timing advanced is released.

After the release of the starting injection timing, as in the conventional arrangement, the timer piston 52 is caused to slide leftwardly or rightwardly in the drawings according to the balance between the inner pressure of the pressure chamber 66 and the elasticity of the spring 54, and the injection timing is appropriately controlled according to the rotation speed of the engine. Even when the rotation speed of the engine is reduced below the above-mentioned predetermined level, if only the auxiliary piston 70 rises from the seal ring 78, since the pressure-receiving area of the auxiliary piston 70 is larger than that at the time of engine starting, resetting of the starting injection timing is prevented.

Figure 3:
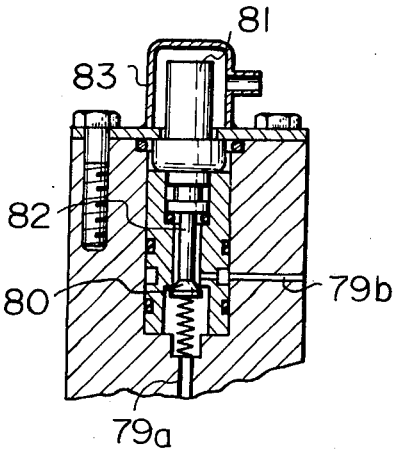
FIG. 3 is an enlarged sectional view of a part including a normally closed valve and its actuator shown in FIG. 2.

When the engine temperature is elevated after the starting, because of the resulting expansion of the wax pellets of the actuator 81, the movable member 82 is moved downwardly in FIGS. 2 and 3 so as to cause the valve 80 to open the passage 79. As a result, the pressure-receiving area of the auxiliary piston 70 is larger than that of the timer piston 52 at the time of engine starting. Accordingly, during a very short period, right after the starting or during cranking caused at the time of the starting, the starting injection timing in the advanced condition is automatically released. Therefore, such disadvantages as increase of the NOx content in the exhaust gas, abnormal combustion, for example, knocking, and production of noises can be eliminated.

In the above-mentioned embodiment, a thermowax is used for opening and closing the valve. In the present device, there may be adopted a modification in which the valve is opened and closed by an electromagnet connected to a temperature detecting circuit, and the structure of the valve is not particularly critical but optional.

As will be apparent from the foregoing illustration, according to the present invention, when the temperature of the engine is lower than the predetermined level, the starting injection timing is maintained at the time of the starting and during a certain period just after the starting. Therefore, the starting and warming-up characteristics of the engine can be improved. Furthermore, when the engine is started in the state when if the engine is already sufficiently warmed up, since the starting injection timing in the advanced condition is automatically released, good conditions can be maintained in the exhaust even after the starting, and production of noises can be eliminated.

What is claimed is:

1. A fuel injection pump for use in a fuel injection combustion engine, comprising:

a housing having a fuel chamber therein;

a plunger movably mounted in said housing and forming a plunger chamber between a head of said plunger and said housing;

first cam means fixedly mounted on said plunger;

second cam means turnably mounted on said housing and cooperating with said first cam means so as to cause reciprocal motion of said plunger along the axis thereof during plunger rotation with respect to said second cam means, said second cam means being capable of taking one of a plurality of angular positions thereof;

fuel supply for introducing fuel into said plunger during a suction stroke of said plunger;

a delivery port for feeding fuel to the engine from said plunger chamber during a delivery stroke of said plunger;

a leak port formed in said plunger and connected to said plunger chamber;

a control sleeve slidably mounted on said plunger for normally closing said leak port and for connecting said leak port to said fuel chamber at the end of the delivery stroke to terminate the fuel injection;

a governor device actuating said control sleeve for controlling the quantity of fuel to be injected;

injection timing control means for controlling the angular position of said second cam means in response to the engine speed;

injection timing adjusting means for providing an adjusted movement of said second cam means toward a determined angular position so as to advance the injection timing under a preselected operating condition of said engine at the engine start;

auxiliary injection timing adjusting means for releasing the adjusting movement of said second cam means by said injection timing adjusting means when the engine temperature is elevated over a predetermined level to effect the controlling of the angular position of said second cam means in response to the engine speed by said injection timing control means;

said injection timing adjusting means including:

a first cylinder and a second cylinder both mounted on said housing;

a first piston slidably mounted in said first cylinder and connected to said second cam means, said first piston forming a pressure chamber over a pressure receiving area $A_1$ thereof and being effected by fuel pressure, in response to the engine speed, introduced into said pressure chamber to move said second cam means toward injection timing advancing;

a first spring urging said first piston toward injection timing retarding, said first piston moving in accordance with the difference between an elasticity of said first spring and said pressure in said pressure chamber, a second piston slidably mounted in said second cylinder coaxially with an axial line of said first piston and having a pressure receiving area $A_2$ facing said pressure chamber, said area $A_2$ being larger than said pressure receiving area $A_1$ of said first piston;

a second spring urging said second piston toward said pressure chamber for causing an end surface to fall in abutting contact with a portion of the end surface of said first piston, by the abutment between said first piston and said second piston, said first piston being adjusted in axial position thereof to a predetermined position where the injection timing is advanced, said second piston moving in accordance with the difference between the elasticity of said second spring and the fuel pressure in said pressure chamber, said second spring having a higher elasticity $F_2$ than elasticity $F_1$ of said first spring, said areas $A_1$ and $A_2$ as well as elasticity $F_1$ and $F_2$ satisfying the following inequality, $$F_1/A_1 > F_2/A_2;$$

and a seal ring being attached to the end surface of said second cylinder facing to said pressure chamber for partitioning said pressure chamber into a central pressure chamber formed between end surfaces of said pistons and an auxiliary pressure chamber between end surfaces of said second piston and said second cylinder when said seal ring is engaged with the end surface of said second piston facing to said pressure chamber, said pressure chamber communicated with said fuel chamber in said housing;

said auxiliary injection timing adjusting means comprising:

a communicating passage formed in said second cylinder for communicating said control pressure chamber with said auxiliary peripheral chamber, and a valve means which opens said communicating passage only when the engine temperature is elevated above a predetermined level.

2. A fuel injection pump as claimed in claim 1, said valve means having a normal closed vlave member for opening or closing said communicating passage, and an actuator for shifting said valve means to open said passage only when the engine temperature is elevated above a predetermined level.

3. A fuel injection pump as claimed in claim 2, said actuator comprises wax pellets being expanded in volume thereof when an engine temperature condition is detected above the predetermined level and a movable member rigidly connecting said valve member with said wax pellets.

4. A fuel injection pump as claimed in claim 3, wherein said second piston includes a projecting portion being slidably mounted within said first cylinder for selectively abutting against said first piston.

* * * * *